US005901647A

United States Patent [19]

Kohlmann

[11] Patent Number: 5,901,647

[45] Date of Patent: May 11, 1999

[54] PROCESS FOR DRIVING EQUIPMENT E.G. A FOLDING DEVICE FOR A ROTARY PRESS

[75] Inventor: Michael Kohlmann, Frankenthal, Germany

[73] Assignee: Koenig & Bauer-Albert Aktiengesellschaft, Wurzburg, Germany

[21] Appl. No.: 08/913,517

[22] PCT Filed: Mar. 12, 1996

[86] PCT No.: PCT/DE96/00437

§ 371 Date: Sep. 18, 1997

§ 102(e) Date: Sep. 18, 1997

[87] PCT Pub. No.: WO96/29204

PCT Pub. Date: Sep. 26, 1996

[30] Foreign Application Priority Data

| | | | |
|---|---|---|---|
| Mar. 18, 1995 | [DE] | Germany | 195 09 948 |
| Jul. 21, 1995 | [DE] | Germany | 195 25 169 |

[51] Int. Cl.[6] ..... B41F 5/00

[52] U.S. Cl. ..... 101/216; 101/227; 101/247; 101/248; 101/181; 364/469.04; 226/19

[58] Field of Search ..... 101/248, 216, 101/227, 181, 982, 247; 493/439, 476, 362; 83/324; 226/45, 19, 20; 364/469.04; 250/231.13, 548

[56] References Cited

U.S. PATENT DOCUMENTS

| | | | |
|---|---|---|---|
| 3,812,351 | 5/1974 | Coberley | 250/231.13 |
| 3,963,902 | 6/1976 | Dowd | 101/181 |
| 4,049,213 | 9/1977 | Hank et al. | 250/548 |
| 4,581,993 | 4/1986 | Schoneberger | 101/248 |
| 4,617,850 | 10/1986 | Bishop | 83/324 |
| 4,809,188 | 2/1989 | Willits et al. | 364/469.04 |
| 4,951,567 | 8/1990 | Rodi et al. . | |
| 5,048,810 | 9/1991 | Palmatier et al. . | |
| 5,117,753 | 6/1992 | Mamberer . | |
| 5,309,834 | 5/1994 | Koch . | |
| 5,481,971 | 1/1996 | Grützmacher et al. . | |
| 5,570,633 | 11/1996 | Schultz et al. | 101/182 |

FOREIGN PATENT DOCUMENTS

| | | |
|---|---|---|
| 0 243 728 | 11/1987 | European Pat. Off. . |
| 0 567 741 | 11/1993 | European Pat. Off. . |
| 0 692 377 | 1/1996 | European Pat. Off. . |
| 0 699 524 | 3/1996 | European Pat. Off. . |
| 1 230 811 | 8/1970 | Germany . |
| 1 960 565 | 11/1974 | Germany . |
| 76 06 107 | 8/1977 | Germany . |
| 35 03 178 | 9/1985 | Germany . |
| 39 29 227 | 3/1991 | Germany . |
| 40 12 396 | 10/1991 | Germany . |
| 41 37 979 | 5/1993 | Germany . |
| 42 30 938 | 3/1994 | Germany . |
| 43 22 744 | 1/1995 | Germany . |
| 44 02 387 | 8/1995 | Germany . |
| 2 281 534 | 3/1995 | United Kingdom . |

*Primary Examiner*—Eugene Eickholt
*Attorney, Agent, or Firm*—Jones, Tullar & Cooper, P.C.

[57] ABSTRACT

Various components in a rotary printing press are driven by suitable electric motors. Each component and its associated drive motor is provided with an angle position sensor. A tolerance range for the rotary angular position of each electric motor is selected. If the actual instantaneous angular position of the motor or component falls outside of the tolerance range, the rotary printing press is stopped.

9 Claims, 2 Drawing Sheets

PROCESS FOR DRIVING EQUIPMENT E.G. A FOLDING DEVICE FOR A ROTARY PRESS

FIELD OF THE INVENTION

The invention relates to a method, and to apparatus for driving a unit, for example a folding device for a rotary printing press.

DESCRIPTION OF THE PRIOR ART

EP 05 67 741 A1 discloses a method for driving rotating components or component groups, wherein an instantaneous tolerance range of their rotary angle position is preset for each selected electric motor drive of selected component groups, and the component groups are equipped with a drive, whose rpm and rotary angle position can be controlled. In the process, an instantaneous actual value of the rotary angle positions and an instantaneous set value of the rotary angle positions of each selected drive are constantly compared with each other.

DE 43 22 744 A1 described a method for driving a unit, wherein a separate motor, whose rotary angle position is controlled, is assigned to each drivable rotating component group. A computer unit is also provided and compares the rotary angle positions of selected component groups or motors.

Interchangeable folding devices for web-fed rotary printing presses are known from DE-AS 19 60 565, whose rotating components, such as perforating rollers, point spurs, cutting and folding blade cylinders, folding cylinders or folding rollers, as well as paddle wheels and delivery belts, are driven via a transverse shaft, a longitudinal shaft and respectively vertical shafts and gear wheel trains.

In this prior art device, it is a limitation that such drive trains have a multitude of gear wheels, drive shafts and the like, which are not only expensive to produce and install, but which also transfer the vibrations, which are created in the individual cylinders, rollers or functional groups of the folding device, to other, for example similar components, by means of drive components, for example gear wheels. This can lead to errors during transfer or passage of folded products which, in turn, can result in so-called "paper plugs", in particular in the belt guide systems, and therefore can cause the outage of the folding device.

SUMMARY OF THE INVENTION

The present invention is based on the object of providing a method and apparatus for driving a unit, for example a folding device of a rotary printing press.

This object is attained by setting an instantaneous tolerance range of the rotary angular position of selected electric motor drives for component groups. The drives for these component groups are selected so that their speed and angular positions can be regulated. An actual value of rotary angle positions is compared with a set value at any instance. If the preset tolerance range is exceeded, a signal is generated by an associated computer.

The advantages which can be achieved by means of the present invention in particular consist in that a mutual negative effect because of the transmission of vibrations to the individual driven components or groups of components of a printing unit or folding device, such as cylinders, drums, rollers and the like, is reduced. Outages of the folding device formerly caused by this vibrational problems are prevented. An elaborate manufacture, assembly and maintenance of the drive elements of the drive trains, as well as oil distribution systems, can be omitted. Furthermore, the effects of defects, which up to now were related with the drive train, cannot be transmitted further. The individual drives can be rapidly exchanged.

BRIEF DESCRIPTION OF THE DRAWINGS

An exemplary embodiment of the present invention is represented in the drawings by means of a folding device, and will be described in more detail below.

Shown are in.

DETAILED DESCRIPTION OF THE PREFERRED EMBODIMENTS

Figure 1:
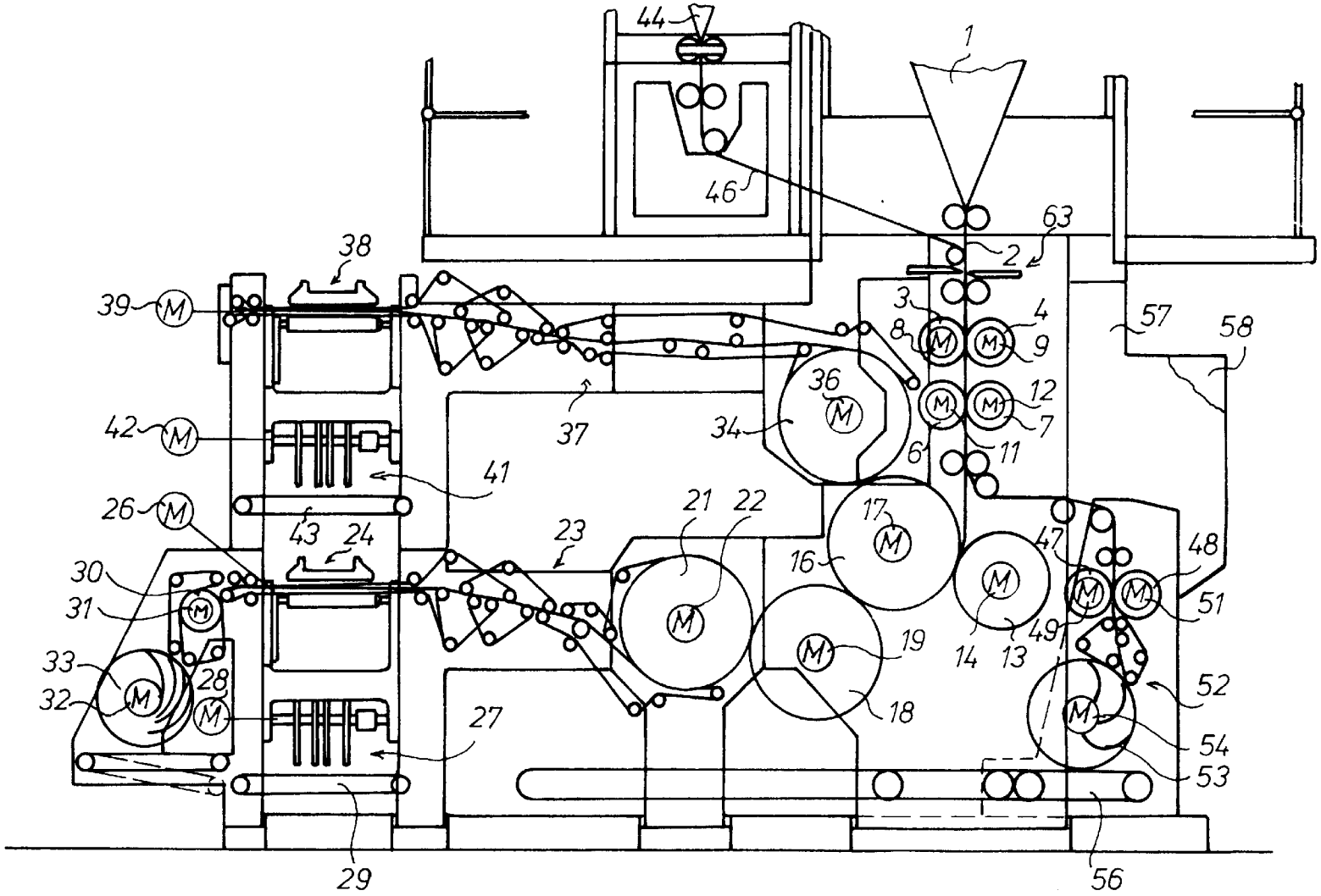
FIG. 1, a lateral view of a folding device with individual drives for the rotating components.

In a second or top plane of a rotary printing press, a folding device has a first former 1 in which a first paper web 2 is provided with a first longitudinal fold. Two pairs of perforating rollers 3, 4 and 6, 7 with respective electrically drivable motors 8, 9 and 11, 12 are arranged in a first or lower plane. Each motor 8, 9, 11, 12 is interlockingly connected with a perforating roller 3, 4, 6, 7, for example by flanging. Subsequently, the longitudinally folded paper web 2 is cut between a cutting cylinder 13, provided with a motor 14, and a cutting groove and folding blade cylinder 16, provided with a motor 17, into signatures, not represented in detail. These signatures are collected, as required, on the cutting groove and folding blade cylinder 16, and thereafter are transversely folded by means of a folding jaw cylinder 18, provided with a motor 19, and are transferred to a further, transverse folding cylinder 21, provided with a motor 22. The transverse folding cylinder 21 is selectively used either for making a second transverse fold in the folded product, or as a transport cylinder. Subsequently, the folded product is fed, via a belt guide system 23, to a longitudinal folding device 24, provided with a motor 26, in which the folded product is longitudinally folded and is caught by means of a paddle wheel 27, provided with a motor 28, which is located under it, and is fed to a delivery belt 29. It is also possible to convey the folded product unfolded through the longitudinal folding device 24 by means of the belt guide system 23 and to feed it by means of a drawing roller 30, provided with a motor 31, to a paddle wheel 32, provided with a motor 33, which delivers the folded product to the delivery belt 29. By means of the folding device, which is depicted in FIG. 1, it is furthermore possible to arrange a second folding jaw cylinder 34, provided with a motor 36, at the cutting groove and folding blade cylinder 16, by means of which the signatures are passed on via a belt guide system 37 to a second longitudinal folding device 38, provided with a motor 39. The folded product is longitudinally folded in this second longitudinal folding device 38 and is caught by means of a paddle wheel 41, provided with a motor 42 located under it, and is fed to a delivery belt 43. In this way, the stream of products leading to each of the longitudinal folding devices 24, 38 can be halved. It is furthermore possible to arrange a second former 44 in the upper plane, by means of which a second paper web 46 is longitudinally folded and is fed to one of the two longitudinal folding devices 24 or 38, while the first paper web 2 is guided to a cutting cassette located next to the cutting cylinder 13. The cutting cassette consists of two transverse cutting cylinders 47, 48, provided with motors 49, 51, a belt guide system 52, a paddle wheel 53, also provided with a motor 54, and a delivery belt 56. All of the above mentioned motors 8, 9, 11, 12, 14, 17, 19, 22, 26, 31, 33, 36, 39, 42, 49, 51, 54, alternatively identified by M8, M9, M11 to Mn are respectively interlockingly connected with their associated drivable rotating components 3, 4, 6, 7, 13, 16, 18, 21, 24, 27, 30, 32, 34, 38, 41, 47, 48, 53, alternatively identified by B3, B4, B6 to Bn, for example by flanged couplings, or alternatively each by means of a toothed belt drive. Drives for various unmentioned drawing rollers, for the delivery belts 29, 43, 56, as well as for the belt guide systems 23, 37 can also be provided with individual drives which, however, are not identified here. The drivable rotating components B3, B4, B6 to Bn are seated in lateral frames 57, 58, wherein the lateral frame 58 is only shown in a small section. The rotating components B3, B4, B6 to Bn can also be arranged in modules which are combined in accordance with the requirements of production techniques. Such a construction of a folding device is described in DE 36 26 287 C2.

Figure 2:
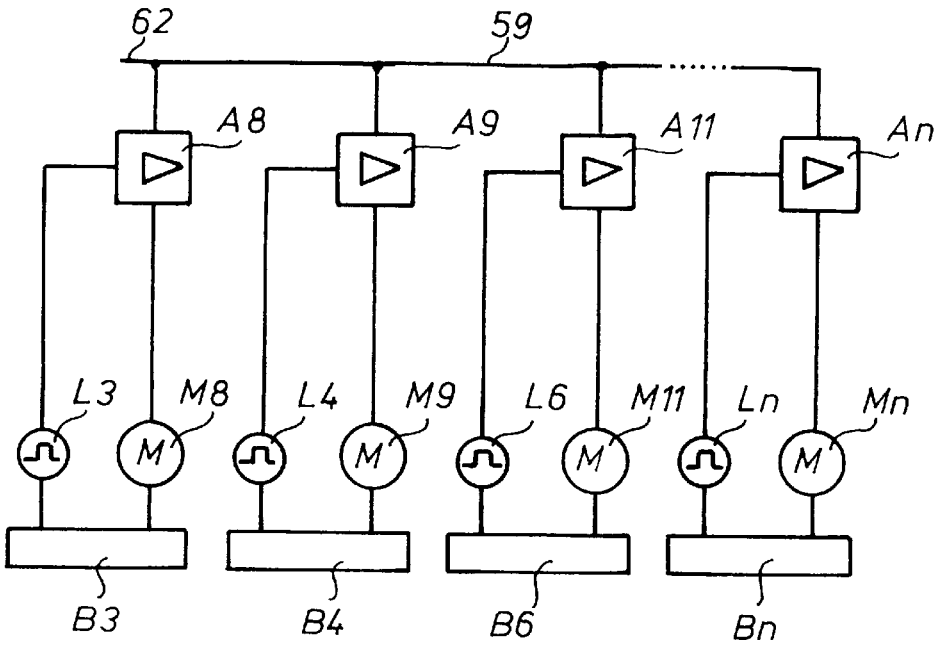
FIG. 2, a basic circuit diagram of the individual electrical drives in accordance with FIG. 1 in a first preferred.
Figure 3:
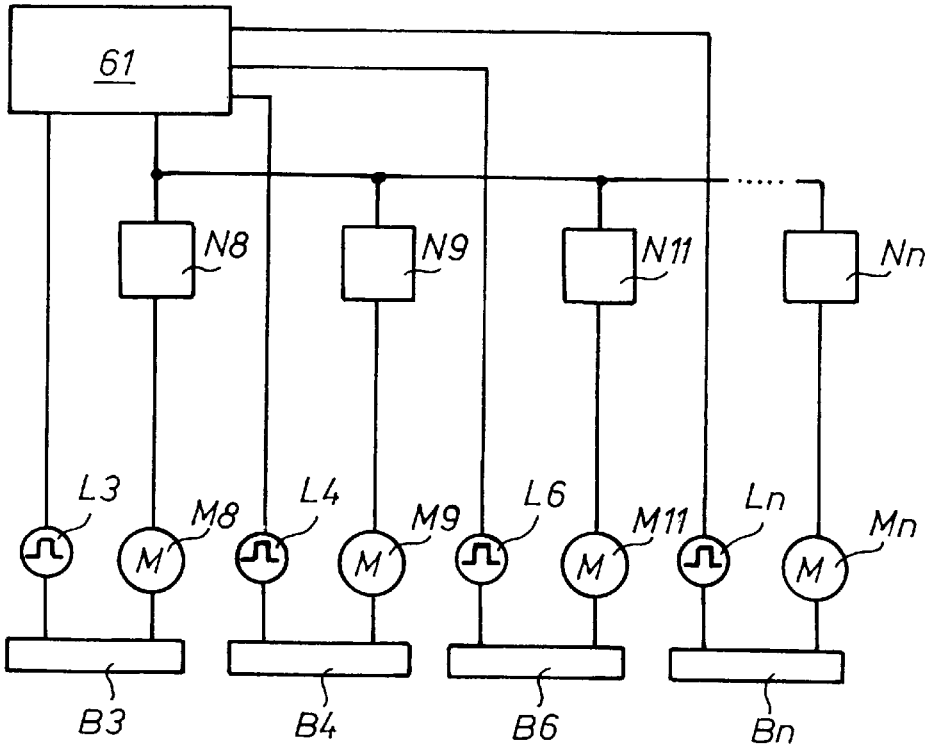
FIG. 3, a basic circuit diagram of the individual electrical drives in accordance with FIG. 1 in accordance with a second preferred embodiment.

Each one, or only selected rotating components or component groups B3, B4, B6 to Bn is respectively interlockingly connected with a position sensor L3, L4, L6 to Ln as depicted schematically in FIGS. 2 and 3. The position sensor can be designed, for example, as a rotating pulse sensor with a reference mark, and can also be interlockingly disposed on the rotating component motor unit B3, M8, B4, M9, B6, M11 to Bn, Mn. Each motor M8, M9, M11 to Mn as well as each position sensor L3, L4, L6 to Ln of a rotating component B3, B4, B6 to Bn is electrically connected with a drive control A8, A9, A11 to An having integrated position detection. For the purpose of a data exchange for synchronization, all drive controls A8, A9, A11 to An are connected by a common data bus 59 as seen in FIG. 2, whose input 62 is connected with the electrical devices of the press control console via a computer unit 61.

In accordance with the method of the present invention, an instantaneous tolerance range of the rotary angular position is preset for each selected electric motor drive M8, M9, M11 to Mn of each component group B3, B4, B6 to Bn. In the process of the present invention, an instantaneous actual value of the rotary angular position of selected drives M8, M9, M11 to Mn is compared in computer 61, for example by means of a reference mark, with the instantaneous set values of the rotary angular position of each selected drive M8, M9, M11 to Mn. In case the preset instantaneous tolerance range of the rotary angular positions of at least one of the selected drives M8, M9, M11 to Mn is upwardly or downwardly exceeded, a safety device for preventing the continued supply of material to the units, for example the printing unit or the folding device, is activated. This safety device can be in the form of a cutting device 63, known per se, for the paper train 2 or 46. Such a safety device could be, for example, cutters cooperating with each other, which cut the paper webs 2, 46 or trains entering the folding device or printing unit. At the same time, a synchronous rapid stop is initiated for selected rotating component groups B3, B4, B6 to Bn. A synchronous rapid stop means that the selected individual component groups B3, B4, B6 to Bn remain synchronized at least until all drives M8, M9, M11 to Mn have been stopped.

In an advantages manner, it is possible to continuously store and to also extrapolate the instantaneous actual and set values of the rotary angular position of each selected component group B3, B4, B6 to Bn within the tolerance range in the computer unit 61. If the extrapolation of instantaneous actual values of the rotary angular position of at least only one of the selected component groups B3, B4, B6 to Bn would lead to the expectation that the tolerance range would be exceeded, an electronic signal is generated by the computer unit 61 and is forwarded to an electrical control unit. The latter issues an optical and/or an acoustical warning signal, for example, or other control commands. The above described rapid stop can then take place. Besides the safety device for cutting the paper web train, for example, the rapid stop device can also include stopping of the folding blade of the longitudinal folding device 24, 38, as well as a pivoting away of guide devices attached to the paddle wheel 33, 53, so that damage to the folding device is prevented. To this end, it is possible to arrange a cutting device 63 for paper trains, known such as is, for example from DE 39 29 227 A1, upstream or downstream of the perforating rollers 3, 4, 6, 7.

When the folding blades of the longitudinal folding device are pivoted away, the folded products are conveyed through the longitudinal folding device without receiving a second longitudinal fold. A pivotable guide device on a paddle wheel is known from DE 42 42 885 A1.

In accordance with a second preferred embodiment of the present invention, as seen in FIG. 3, each motor M8, M9, M11 to Mn of a rotating component group B3, B4, B6 to Bn is electrically connected with a power element N8, N9, N11 to Nn. Both the power elements N8, N9, N11 to Nn and the position sensors L3, L4, L6 to Ln of each rotating component group B3, B4, B6 to Bn are electrically connected with a computer unit 61, for example a composite of one or several signal processors for detecting the position, for example the rotary angular position, of the rotating elements. For d.c., each respective power element N8, N9, N11 to Nn can consist of thyristors, and for a.c. of IGBTs.

While preferred embodiments of a method and apparatus for driving a unit or units in a rotary printing press in accordance with the present invention have been set forth fully and completely hereinabove, it will be apparent to one of skill in the art that a number of changes in, for example, the overall size of the unit, the type of printing being accomplished, the type of web being printed and the like may be made without departing from the true spirit and scope of the present invention, which is accordingly to be limited only by the following claims.

I claim:

1. A drive for rotating component groups of a rotary printing press comprising:

a separate angular position controllable rotary motor for each said rotating component group;

means for detecting a rotary angular position for each said rotating component group;

a computer unit, said computer unit receiving angular position values from said angular position detecting means for each said rotating component group;

a safety device including a cutting device useable to cut a paper web train being printed in said rotary printing press; and means for actuating said cutting device when said angular position values received by said computer deviate from a tolerance range for said angular position values.

2. The drive of claim 1 further including a data bus connecting all of said drive controls.

3. The drive of claim 1 further including a power element associated with each said motor.

4. The drive of claim 3 wherein each said power element is connected with said computer unit.

5. The device of claim 1 wherein said safety device further including means to accomplish a rapid stop of at least selected ones of said rotating component groups.

6. A drive for rotating component groups of a rotary printing press comprising:

a separate angular position controllable rotary motor for each said rotating component group;

means for detecting a rotary angular position for each said rotating component group;

a computer unit, said computer unit receiving angular position values from said angular position detecting means for each said rotating component group;

a safety device including means to accomplish a rapid stop of selecting ones of said rotating component groups; and means for actuating said safety device when said angular position values received by said computer deviate from a tolerance range for said angular position values.

7. The device of claim 6 further including means for maintaining said rotating component groups in synchronization during said rapid stoppage of said selected ones of said rotating component groups.

8. The device of claim 7 further including means for selecting said tolerance range to prevent damage to said rotary printing press.

9. The device of claim 6 further including means for issuing a warning before said angular position values deviate from said tolerance range.

* * * * *